US005981876A

United States Patent [19]

Fukui

[11] Patent Number: 5,981,876

[45] **Date of Patent: *Nov. 9, 1999**

[54] PC CABLE PROTECTIVE SHEATH FOR PRESTRESSED CONCRETE

[75] Inventor: Kouki Fukui, Osaka, Japan

[73] Assignee: Totaku Industries, Inc., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,951

[22] Filed: Nov. 19, 1996

[30] Foreign Application Priority Data

Nov. 24, 1995 [JP] Japan ..... 7-329806

[51] Int. Cl.[6] ..... H01B 7/18

[52] U.S. Cl. ..... 174/106 D; 174/102 D; 174/37; 174/68.3; 138/122

[58] Field of Search ..... 174/106 D, 102 SP, 174/102 D, 102 E, 85, 136, 37, 39, 68.3; 138/122, 121, 129

[56] References Cited

U.S. PATENT DOCUMENTS

| | | | |
|---|---|---|---|
| 2,901,024 | 8/1959 | Marsden, Jr. | 138/122 X |
| 3,313,319 | 4/1967 | Osborn et al. | 174/102 D X |
| 3,509,266 | 4/1970 | Endacott | 174/37 X |
| 4,079,757 | 3/1978 | Fischer et al. | 138/121 |
| 4,088,830 | 5/1978 | Wargin et al. | 174/102 SP X |
| 4,256,921 | 3/1981 | Bahder | 174/106 D X |
| 5,125,199 | 6/1992 | Whitney et al. | 174/68.3 X |
| 5,148,836 | 9/1992 | Lawrence | 138/122 X |
| 5,462,090 | 10/1995 | Winter et al. | 138/122 X |
| 5,492,151 | 2/1996 | Wood et al. | 138/121 |

FOREIGN PATENT DOCUMENTS 621953 6/1994 Japan .

*Primary Examiner*—Dean A. Reichard
*Attorney, Agent, or Firm*—Whitham, Curtis & Whitham

[57] ABSTRACT

A sheath is provided with necessary conditions where inner and outer surfaces thereof are both formed in an uneven helical shape, where the outer surface of a trough is almost flat, where a width W of the trough between inflection points of a curve along the inner surface of the trough and a width w of a top between inflection points of a curve along the top satisfy the relation of W>w, where a thickness T of the trough and a thickness t of the top satisfy the relation of T>t, where a projection of the inner surface of the trough is formed in a gentle arc compared to a recess of the inner surface of the top, and where an inner perimeter of the recess of the inner surface projects circumferentially outward more than an outer-perimeter of the outer surface of the trough. The sheath is entirely formed of polyolefin resin material.

14 Claims, 4 Drawing Sheets

PC CABLE PROTECTIVE SHEATH FOR PRESTRESSED CONCRETE

BACKGROUND OF THE INVENTION

The present invention relates to a protective sheath which houses a prestressed concrete (hereinafter "PC") cable such as PC steel wire, PC twisted steel wire or PC steel rod that is used as tension wire in post-tension techniques or pretension techniques during construction of prestressed concrete structures, and which protects the PC cable by preventing it from coming into direct contact with the concrete.

Conventionally, as means for rust-proofing and preventing deterioration of the PC cables used in the construction of this kind of prestressed concrete structure, a steel sheath is generally used so that the PC cable does not come into direct contact with the concrete. On the other hand, instead of this steel sheath, the use of a synthetic resin sheath has begun to be proposed.

With regard to the former steel sheath which has been generally used heretofore, there is a type in which annular irregularities are formed in the sheath (node application) and a type in which helical irregularities are formed (wave application). In both the types, the entire pipe wall is of uniform thickness. With regard to the latter synthetic resin sheath currently being proposed, its form is the same as that of the steel sheath, its wall thickness is entirely uniform, and its uneven wave shape is formed in simple arc-shaped waves (for example, see Japanese Utility Model Unexamined Publication No. Hei 6-21953).

With respect to the steel sheath, since it comes into direct contact with the concrete, it tends to be corroded by salinity contained in or adhering to sands (fine aggregate) contained in the concrete. In particular, there is a problem that rust and deterioration tend to occur due to acid rain which penetrates through minute cracks in the concrete. Moreover, salt damage tends to occur in structures located in the sea, on the sea, or within 100 m of the coastline, and salt damage countermeasures have become a major issue. On the other hand, with respect to the synthetic resin sheath, there is a problem that countermeasures must be developed for the low compression deformation resistance in the circumferential and axial directions, and low abrasion resistance, which are characteristics of synthetic resin.

SUMMARY OF THE INVENTION

Thus, in order to solve the problems of the conventional steel sheath, the present invention provides a protective sheath for a PC cable, which uses synthetic resin strongly resistant to acid rain and salt damage, particularly polyolefin resin, and has a specific configuration to improve the low compression deformation resistance and abrasion resistance of the synthetic resin, thereby replacing the steel sheath which has been generally used heretofore.

A PC cable protective sheath of the present invention comprises a pipe wall with inner and outer surfaces each having an uneven helical shape so that the pipe wall includes a top and a trough, wherein the outer surface of the trough is almost flat, wherein a width W of the trough between inflection points of a curve along the inner surface of the trough and a width w of the top between inflection points of a curve along the top satisfy the relation of W>w, wherein a thickness T of the trough and a thickness t of the top satisfy the relation of T>t, wherein a projection of the inner surface of the trough is formed in a gentle arc compared to a recess of the inner surface of the top, and wherein an inner perimeter of the recess of the inner surface projects circumferentially outward more than an outer perimeter of the outer surface of the trough, the sheath being entirely formed of polyolefin resin material.

In practicing the present invention having the above described configuration, it is preferable that the thickness T of the trough is made thick, and the thickness t of the top is made thinner relative to the former thickness so that their ratio meets the relation of $T \geqq 1.5t$; that the inner perimeter of the recess of the inner surface is formed to circumferentially project outward more than the outer perimeter of the outer surface of the trough, and an amount b of projection outward in the circumferential direction from the outer perimeter of the trough to the inner perimeter of the recess satisfies the relation of b>t when compared with the thickness t of the top; and that high-density polyethylene resin (HDPE: density JIS standard 0.942 g/cm$^3$ or more) is used as the polyolefin resin material constituting the sheath.

DETAILED DESCRIPTION OF THE INVENTION

Figure 1:
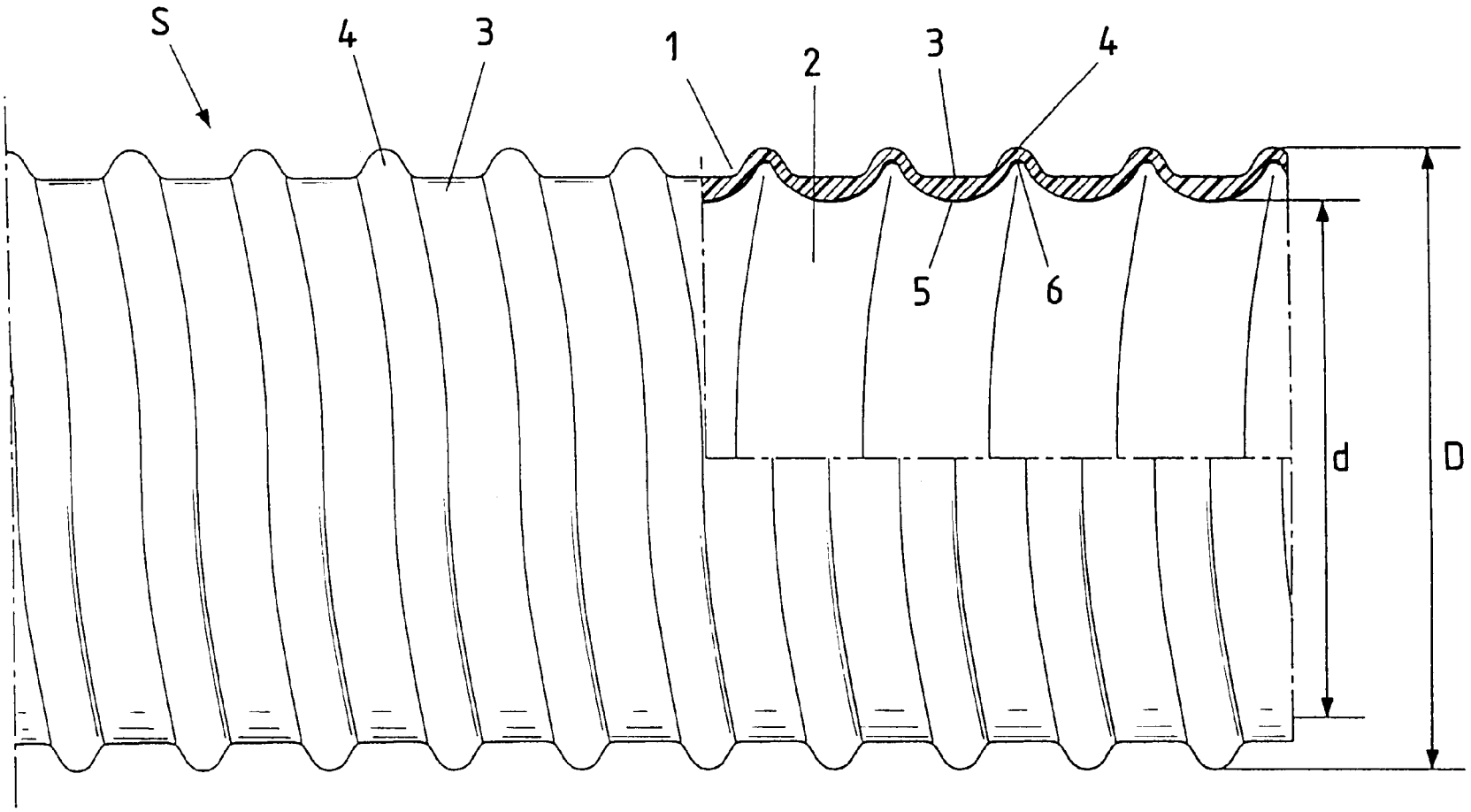
FIG. 1 is a partial cut-out front view showing an embodiment of the present invention.
Figure 2:
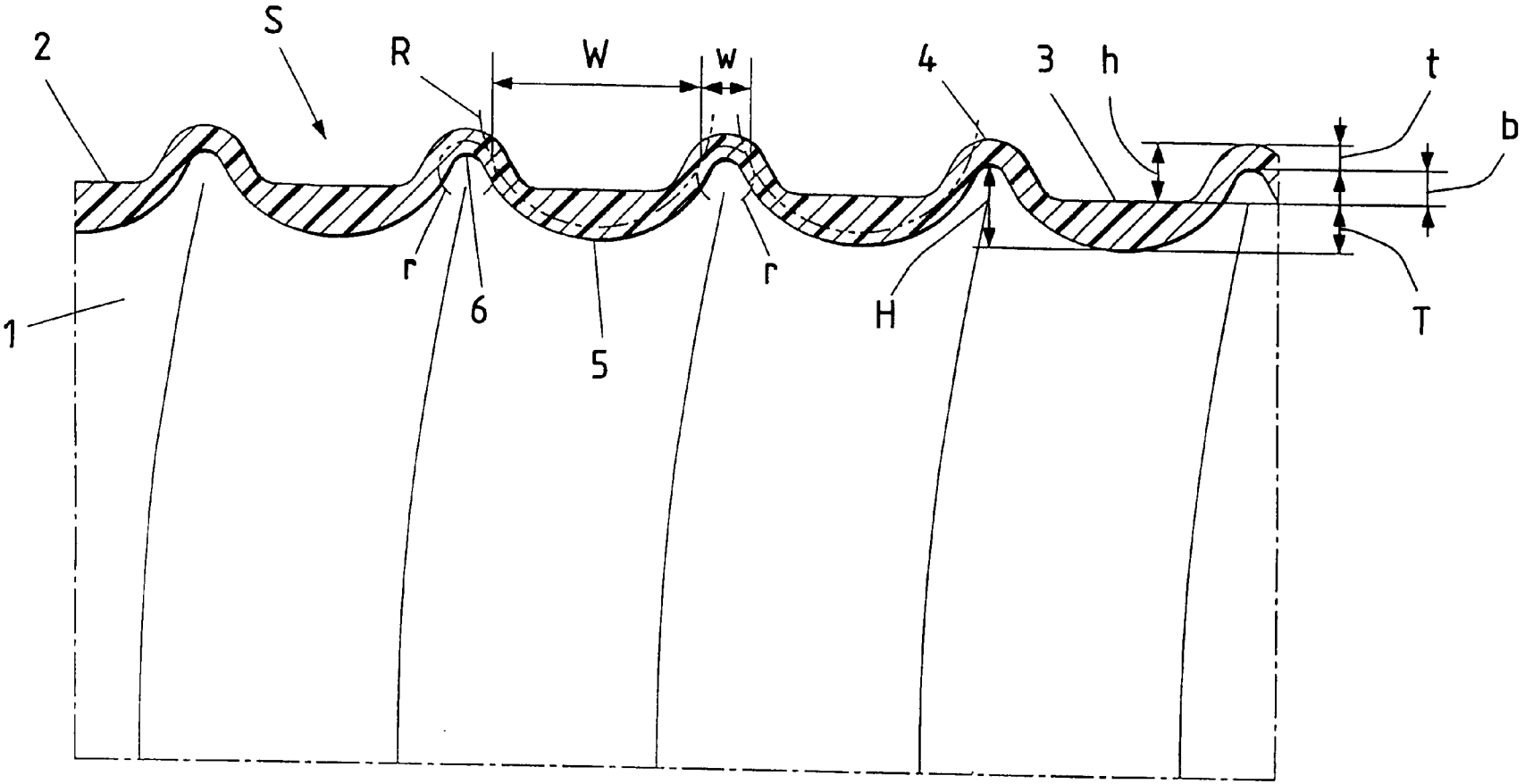
FIG. 2 is an enlarged vertical sectional view showing a pipe wall portion.
Figure 3:
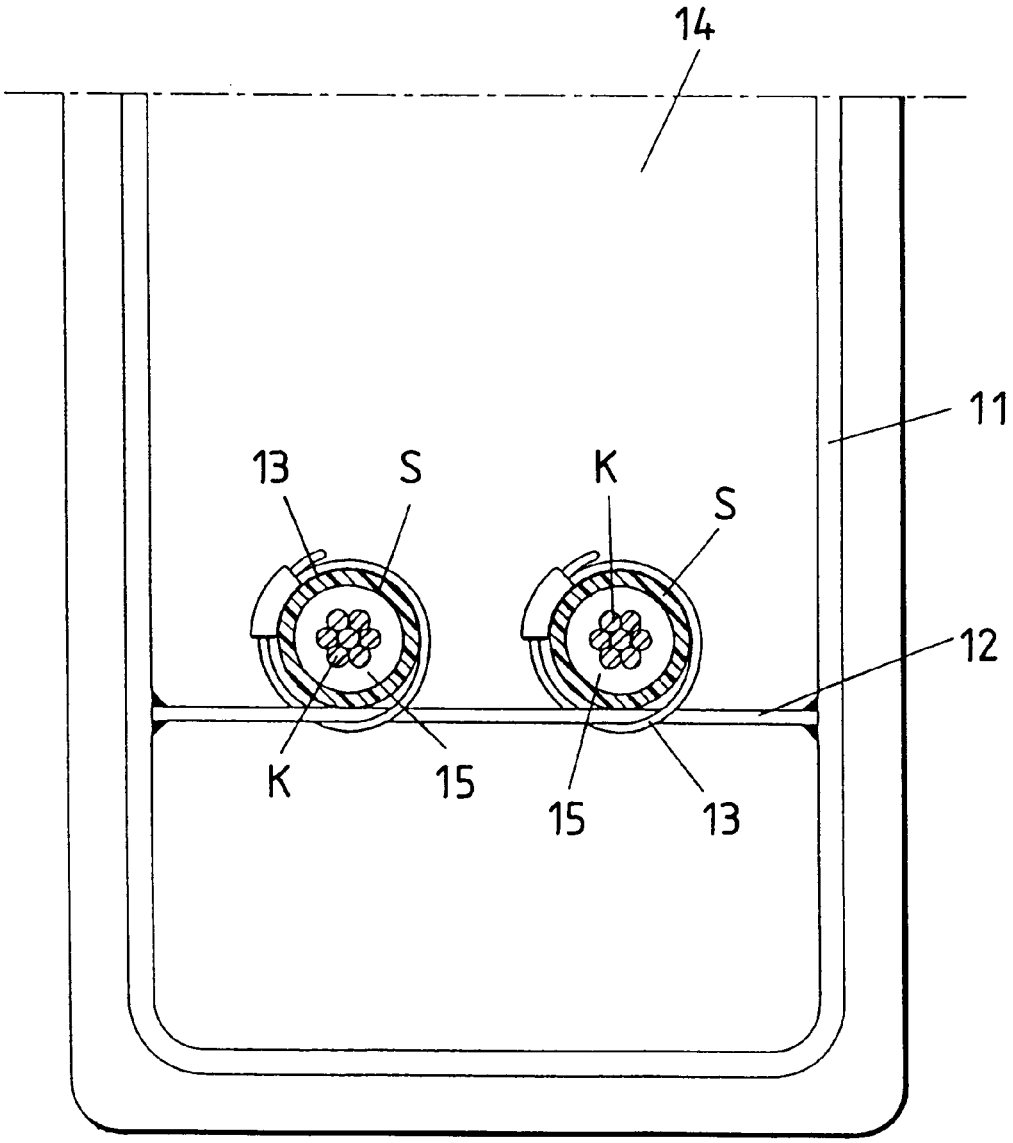
FIG. 3 is a cross-sectional view showing means for fixing a sheath in the implantation space in concrete.
Figure 4:
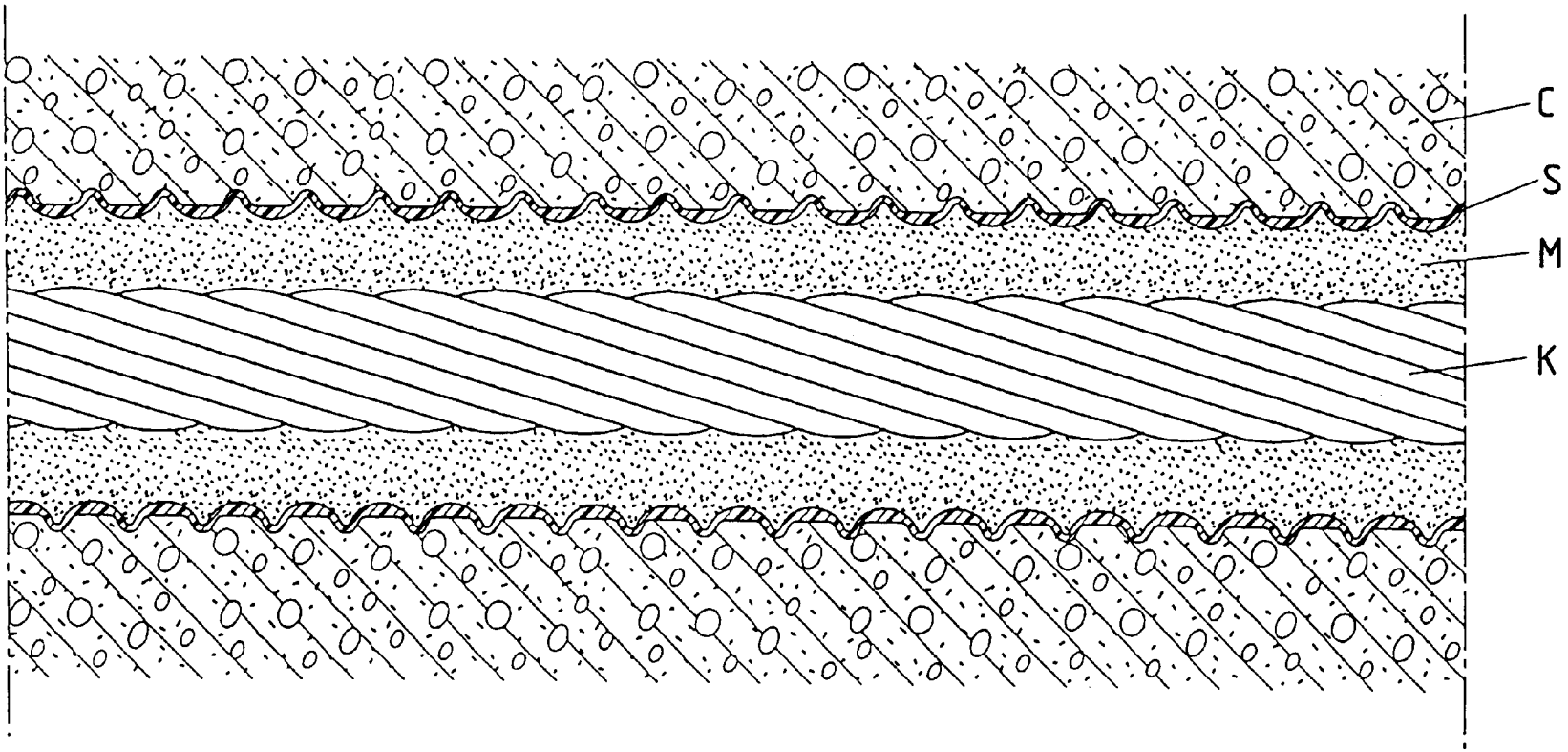
FIG. 4 is a vertical sectional view showing the state of use.

Preferred embodiments of the present invention will now be explained with reference to the accompanying drawings. FIG. 1 to FIG. 4 are drawings which illustrate a basic embodiment of the present invention: FIG. 1 is a view showing a sheath S of the embodiment in which a part of the sheath is cut away; FIG. 2 is a structural explanatory view in which a pipe wall part of the sheath is enlarged; FIG. 3 is an explanatory view illustrating means for fixing the sheath to a holding steel rod; and FIG. 4 is a cross-sectional view showing the state in which the sheath is buried in a concrete structure.

In the PC cable protective sheath S of the present invention, inner and outer surfaces 1 and 2 of the sheath are both formed in an uneven helical shape. The outer surface 2 at a trough 3 which forms the unevenness is almost flat as illustrated in FIG. 1 and FIG. 2. An apex of a top 4 is arc-shaped, and oblique lines of both sides of the top are slopes forming two legs of an almost equilateral triangle, and connect with the trough 3. As illustrated in FIG. 2, width W of the trough 3 in the axial direction between inflection points of a curve shown by imaginary line R along the inner surface of the trough 3 is formed so as to be larger than width w in the axial direction between inflection points of the curve shown by imaginary line r along the top 4. Moreover, thickness T of the trough 3 is formed to be 1.5 to 3 times as thick as thickness t of the top 4. In this embodiment, the thickness T is approximately twice the thickness t of the top 4. A projection 5 of the inner surface 1 is wider than a concave angle of a recess 6, and is formed into a gentle arc. In contrast, the recess 6 has a narrow width, and rises at a sharp angle in a hill shape.

As shown in FIG. 2, height H from the plane of the projection 5 which projects farthest toward the pipe interior to the inner perimeter of the deepest part of the recess 6 is formed to be greater than height h from the outer perimeter of the trough 3 to the farthest projecting plane of the top 4. The position of the inner perimeter of the deepest part of the recess 6 is formed to project circumferentially outward more than the position of the outer perimeter of the trough 3 at the outer surface 2 by the amount shown by reference character b. The entire ty of the sheath S is formed of polyolefin resin material, particularly high-density polyethylene resin.

With respect to the sheath S of the embodiment, the present applicant produced a sheath for experimental purposes, to which testing was conducted. The sheath S has an internal diameter d of 65 mm and an external diameter D of 78 mm, and the size of each part thereof is specifically as follows: the pitch is 16 mm, the width W of the trough 3 is W=12 mm, the width w of the top 4 is w=4 mm, the thickness T of the trough 3 is T=3 mm, the thickness t of the top 4 is t=1.5 mm, the ratio T:t of both parts is 2:1, the height H from the plane of the projection 5 which projects farthest toward the pipe interior to the inner perimeter of the deepest part of the recess 6 is H=5 mm, the height h from the outer perimeter of the trough 3 to the farthest projecting plane of the top 4 is h=3.5 mm, and the amount of projection b circumferentially outward from the outer perimeter of the trough 3 to the inner perimeter of the recess 6 is b=2 mm. Hard high-density polyethylene resin is used as the resin material.

The reason for using the hard high-density polyethylene resin as the resin material is that it has characteristics of being lightweight, not rusting and not corroding, and has numerous superior properties: it has superior moldability which allows easy obtainment of products of complex form, is highly rigid, strongly resists shocks without being damaged, withstands the shocks and strong loads applied at pouring of concrete, has superior electrical insulation performance, water resistance and water proofing, strongly resists acid rain and salt damage, and maintains shielding capability over long periods of time. Furthermore, it has the characteristic that there is no marked increase in friction during prestressing.

Upon subjecting this sheath to practical tests, in temperature variation tests, there occurred no cracking in the sheath by temperature changes from 7° C. to 60°. in abrasion resistance tests, there occurred almost no damage due to friction against the PC cable at the time of tension. In testing of adhesion with concrete, there was found to be no difference from steel sheaths. It was also found that there was no occurrence of formation of aperatures which result when sparks are generated during electric welding, which tends to occur in steel sheaths.

With respect to the sheath S of the present invention, as a common method which is shown in FIG. 3, a steel rod 12 designed to hold the sheath is fixed to a stirrup 11 by conducting electric welding at specified intervals in the horizontal direction, a required reinforcing steel rod is disposed, the sheath S is arranged on this reinforcing steel rod or the aforementioned steel rod 12, and it is either bound to the steel rod 12 by steel wire with a diameter of 1 mm, or is clamped by a polyethylene clamping band 13 in case that there is fear of corrosion of the steel wire. After being arranged in this way, concrete is poured into the space 14 in the stirrup 11 and allowed to harden.

PC cable K is inserted into the sheath S which has been buried in concrete in this manner, and a hardener M such as mortar is injected into the space 15 in the sheath S simultaneously with the insertion of this PC cable K. The sheath S, hardener M and PC cable K are buried in the concrete C as shown in FIG. 4, tension is applied to the PC cable K to harden the hardener M.

Although the above description relates to a representative embodiment of the present invention, the present invention is not necessarily limited to the structure shown in this embodiment, and can be applied with appropriate modifications within the range of effects described below so long as the aforementioned necessary conditions of the present invention are provided, and the objects of the present invention are obtained.

As is clear from the foregoing explanation, in the PC cable protective sheath of the present invention, the outer surface formed into an uneven helical shape is almost flat at the portion of the trough 3, and the width W of the trough in the axial direction and the width w of the top 4 satisfy the relation of W>w, so that the wide and flat-bottomed concrete positioned on the perimeter of the trough 3 securely prevents any movement of the sheath in the axial direction. In addition, since the inner perimeter of the recess 6 is formed so that it is circumferentially positioned farther outward than the outer perimeter of this trough 3, the hardener M which is positioned inside the recess 6 via the top 4 of the sheath becomes integrated and prevents still more securely any movement of the sheath in the axial direction. Thus, it becomes possible to stabilize the sheath inside the concrete. Moreover, while the thickness T of the trough 3 is made larger than the thickness t of the top 4 to achieve saving of raw materials and lightening in the entire sheath, the projection 5 of the inner surface of the trough 3 is formed into a gentle arc, and the aforementioned W>w relation is maintained. As a result, not only sliding is improved at the time of PC cable insertion, but also abrasion resistance is reinforced so that damage does not easily occur even when the sheath is abraded by friction against the PC cable.

Furthermore, the height H from the farthest projecting plane of the projection 5 to the inner perimeter of the recess 6 is made greater than the height h from the outer perimeter of the trough 3 to the farthest projecting plane of the top 4, and, as mentioned above, the inner perimeter of the recess 6 is made to project circumferentially outward more than the outer perimeter of the trough 3. Consequently, while the width of the projection 5 which compensates for abrasion damage resistance, is made large, the degree of bonding of the hardener M to the sheath S is increased, and it is possible to maximize the protection of the PC cable.

Furthermore, by forming the entire sheath of a polyolefin resin material, the sheath has the properties of being lightweight, non-rusting and non-corrosive, and the properties of having superior moldability, being easy to manufacture and being suited to mass production. Further, the sheath has such superior effects that it is highly rigid, strongly resists shocks without being damaged, withstands the shocks and strong loads applied at pouring of concrete, has superior electrical insulation performance, water resistance and water proofing, strongly resists acid rain and salt damage, and maintains shielding capability over long periods of time.

What is claimed is:

1. A prestressed concrete ("PC") cable protective sheath for covering and protecting a PC cable, said PC cable being inserted into said sheath, said protective sheath comprising:

a pipe wall having inner and outer surfaces formed in a helical shape such that said pipe wall includes a top and a trough;

a hardener placed in an inner space of a pipe formed by said inner surface of said pipe wall, said hardener maintaining said PC cable within said sheath, wherein:

said outer surface of said trough is substantially flat;

said helical shape has inflection points separating said top and said trough;

said trough has a width W between said inflection points and said top has a width w between said inflection points of adjacent troughs, wherein W>x;

said trough has a thickness T and said top has a thickness t, wherein T>t;

said inner surface has an interior projection along said trough comprising an arc and a recess along said top;

said recess projecting radially from a central axis of said sheath more than said outer surface of said trough; and said sheath comprising entirely polyolefin resin material.

2. A PC cable protective sheath according to claim 1, wherein T≧1.5 t.

3. A PC cable protective sheath according to claim 1, wherein said recess projects radially from a central axis of said sheath more than said outer surface of said trough by an amount b wherein b is larger than the thickness t.

4. A PC cable protective sheath according to claim 2, wherein said recess projects radially from a central axis of said sheath more than said outer surface of said trough by an amount b wherein b is larger than the thickness t.

5. A PC cable protective sheath according to claim 1, wherein the polyolefin resin material comprises a high-density polyethylene resin.

6. A PC cable protective sheath as in claim 1, wherein:

said top includes an arc shape, and oblique lines of said top are slopes forming two legs of an approximate equilateral triangle.

7. A PC cable protective sheath as in claim 1, wherein said hardener comprises mortar.

8. A sheath comprising:

an inner surface having a first helical shape and an outer surface having a second helical shape, said inner surface and said outer surface having inflection points where said first helical shape and said second helical shape change curvature direction;

a hardener placed in an inner space a pipe formed by said inner surfaces of said pipe wall, said hardener maintaining said PC cable within said sheath and said sheath covering said PC cable within prestressed concrete;

a plurality of tops formed along said inner surface and said outer surface; and a plurality of troughs alternating with said tops and being formed along said inner surface and said outer surface, said tops each having a convex shape along said outer surface and a concave shape along said inner surface, said troughs each having a flat surface along said outer surface and a convex surface along said inner surface, said flat outer surface of each of said troughs preventing said sheath from moving within said prestressed concrete, said troughs each having a first width extending between adjacent ones of said inflection points along said inner surface and said outer surface, said tops each having a second width extending between adjacent ones of said inflection points along said inner surface and said outer surface, and said first width being greater than said second width.

9. A sheath as in claim 8, wherein said first width is greater than or equal to 1.5 times said second width.

10. A sheath as in claim 8, wherein said troughs each have a first maximum thickness between said inner surface and said outer surface and said tops each have a second maximum thickness between said inner surface and said outer surface, wherein said first maximum thickness is greater than said second maximum thickness.

11. A sheath as in claim 8, wherein:

said outer surface of each of said troughs extending a first distance radially from a central axis of said sheath, said inner surface of each of said tops extending a second distance radially from said central axis, and said second distance is greater than said first distance.

12. A sheath as in claim 8, wherein:

said outer surface of each of said troughs extend a first distance radially from a central axis of said sheath and said inner surface of each of said tops extend a second distance radially from said central axis, a first difference comprising a difference between said first distance and said second distance, said tops each having a maximum thickness between said inner surface and said outer surface, said first difference is greater than said maximum thickness.

13. A sheath as in claim 8, wherein said sheath comprises resin.

14. A sheath as in claim 13, wherein said resin comprises polyethylene resin.

* * * * *